US006286243B1

(12) United States Patent
Hinton

(10) Patent No.: US 6,286,243 B1
(45) Date of Patent: Sep. 11, 2001

(54) DEVICE FOR LOADING CARTRIDGES INTO A MAGAZINE

(76) Inventor: Thomas G. Hinton, HC 5, Box 775, Old Town, FL (US) 32680

( * ) Notice: Subject to any disclaimer, the term of this patent is extended or adjusted under 35 U.S.C. 154(b) by 0 days.

(21) Appl. No.: 09/560,347

(22) Filed: Apr. 28, 2000

(51) Int. Cl.[7] ..... F41A 9/61; F41A 9/82
(52) U.S. Cl. ..... 42/87
(58) Field of Search ..... 42/87, 88, 90, 42/49.01, 106

(56) References Cited

U.S. PATENT DOCUMENTS

| | | | | |
|---|---|---|---|---|
| 4,464,855 | | 8/1984 | Musgrave | 42/87 |
| 4,488,371 | * | 12/1984 | Boyles | 42/87 |
| 4,829,693 | | 5/1989 | Holmes | 42/87 |
| 4,888,902 | | 12/1989 | Knowles | 42/87 |
| 4,993,180 | | 2/1991 | Upchurch | 42/87 |
| 5,129,173 | * | 7/1992 | Kuykendall | 42/87 |
| 5,249,386 | * | 10/1993 | Switzer | 42/87 |
| 5,355,606 | | 10/1994 | Origoni | 42/87 |

FOREIGN PATENT DOCUMENTS

| | | |
|---|---|---|
| 304379 | 11/1921 | (DE) . |
| 555367 | 8/1943 | (FR) . |

* cited by examiner

*Primary Examiner*—Charles T. Jordan
*Assistant Examiner*—Elizabeth Shaw
(74) *Attorney, Agent, or Firm*—Stephen R. Greiner

(57) ABSTRACT

A device for loading cartridges into a magazine including a body with a U-shaped cross section adapted to slide up and down upon the exterior of a magazine. A lever projects rearwardly from the bottom of the body and a hook projects upwardly from the top of the body for grasping and manipulating cartridges. The hook has a shank as well as a catch that terminates at a concave free end for snugly engaging cartridges.

5 Claims, 1 Drawing Sheet

DEVICE FOR LOADING CARTRIDGES INTO A MAGAZINE

FIELD OF THE INVENTION

The present invention relates generally to firearms and, in particular, to magazine chargers.

BACKGROUND OF THE INVENTION

Many firearms utilize selectively removable magazines containing a plurality of bullet cartridges. These magazines typically include a tubular body of rectangular cross section and hold cartridges lying atop one another. A mouth is provided at the upper end of the body into which cartridges can be laterally inserted beneath a pair of cartridge-retaining lips spaced from one another at a distance less than the diameter of a cartridge. A compressed spring at the bottom of the tubular body retains the uppermost cartridge against the lips in a "ready" position to be ejected from the magazine. Since the cartridges and the mouth of the body are small, and since the resistance of the spring must be worked against, filling a magazine can be difficult.

Numerous devices have been proposed to facilitate the filling of a magazine with cartridges. Most are cumbersome in construction having numerous working parts and require that cartridges be manually manipulated after positioning such within the mouth of a magazine's tubular body. None grasp a cartridge, draw it into a tubular body, and seat it in a position where the next cartridge can be easily loaded. A need, therefore, exists for a device of uncomplicated construction that provides "hands-free" cartridge loading after a cartridge is positioned within a magazine's mouth.

SUMMARY OF THE INVENTION

In light of the problems associated with the known devices for loading cartridges into magazines used in firearms, it is a principal object of the invention to provide a device that will facilitate the loading of a firearm magazine. The inventive device does this by: 1) grasping a cartridge positioned within the mouth of a magazine, 2) sliding the cartridge laterally to a position fully within the tubular body of the magazine, and 3) pressing the cartridge downwardly against the force of the magazine's spring so that another cartridge can be positioned within the mouth so that the loading process can be initiated anew with another cartridge.

It is another object of the invention to provide a cartridge loading device of the type described that can be used without prolonged instruction, specialized tools, or modification to a firearm magazine.

It is an object of the invention to provide improved elements and arrangements thereof in a device for loading cartridges into a magazine for the purposes described which is uncomplicated and lightweight in construction, inexpensive to manufacture, and dependable in use.

Briefly, the device in accordance with this invention achieves the intended objects by featuring a body having a U-shaped cross section adapted to slide upon the exterior of a magazine. The body includes a rectangular plate dimensioned for positioning against the rear of a magazine and a pair of retaining arms projecting forwardly from the opposite sides of the plate. The retaining arms are adapted for sliding engagement with the sides of a magazine. A lever projects rearwardly from the bottom of the plate for movement of the device by a user. A hook is provided for grasping and manipulating cartridges. The hook has a shank attached to the top of the plate and extending upwardly and forwardly therefrom and a catch attached to the top of the shank and extending downwardly and forwardly therefrom. The catch terminates at a concave free end adapted to snugly engage a cartridge. Preferably; the body, lever, and hook are integrally formed from a single piece of sheet metal.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
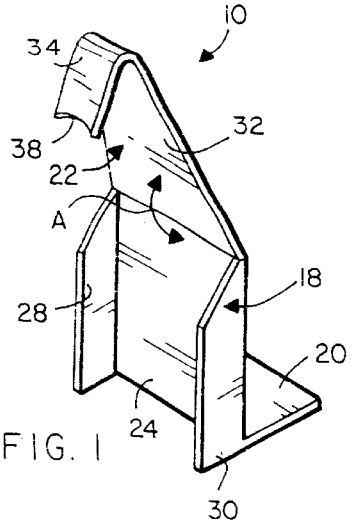
FIG. 1 is a perspective view of a device for loading cartridges into a magazine for a firearm in accordance with the present invention.
Figure 2:
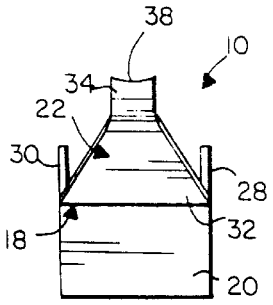
FIG. 2 is a top view of the cartridge-loading device of FIG. 1.
Figure 3:
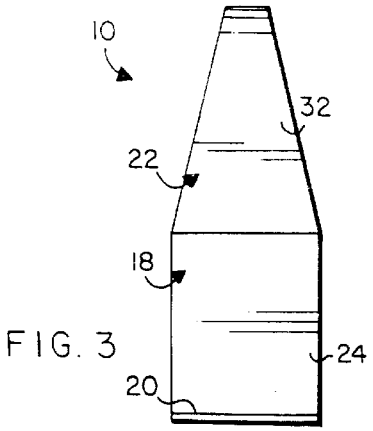
FIG. 3 is a rear view of the cartridge-loading device.

Referring now to the Figures, a device 10 is shown for loading cartridges as at 12 and 14 into a firearm magazine 16. Device 10 includes a body 18 having a U-shaped cross-section and being adapted to slide up and down upon the exterior of magazine 16. Projecting rearwardly from the bottom of body 18 is a lever 20 that may be held by a user to move device 10. A hook 22 extends from the top of body 18 for grasping and manipulating cartridges 12 and 14.

Body 18 has a rectangular plate 24 dimensioned for positioning against the rear of the tubular body 26 of magazine 16. Projecting forwardly from the opposite sides of plate 24 are a pair of retaining arms 28 and 30 adapted for sliding engagement with the sides of tubular body 26. Arms 28 and 30 are parallel to one another and their tops taper toward the top of plate 24.

Hook 22 includes a shank 32 attached at its bottom to the top of plate 24 and a catch 34 attached to the top of shank 32. Shank 32 is triangular in form, tapering in width from its bottom to its top, and is oriented at an angle A of about 155 degrees to plate 24 so that it pitches forwardly. This forward pitch of shank 32 causes such to engage the rear of body 26 at a slight angle and lever cartridge 12 rearwardly from mouth 40. Catch 34 smoothly adjoins the top of shank 32 and has a width adequate to be positioned between the cartridge retaining lips 36 (note: only one shown) at the top of magazine 16. As shown, catch 34 slopes downwardly from shank 32 at an angle B of about 30 degrees and terminates at a concave free end 38 adapted to snugly engage cartridge 12 or 14.

Device 10 is integrally formed from a single piece of stiff sheet metal. After cutting to the appropriate shape, the piece would be bent into an appropriate shape with arms 28 and 30 and hook 22 being bent generally forwardly from plate 24 and lever 20 being bent rearwardly from plate 24. Of course, device 10 may be formed from any suitable material using any compatible manufacturing technique. Thus, it is possible that device 10 could be molded from plastic or like substance.

Figure 4:
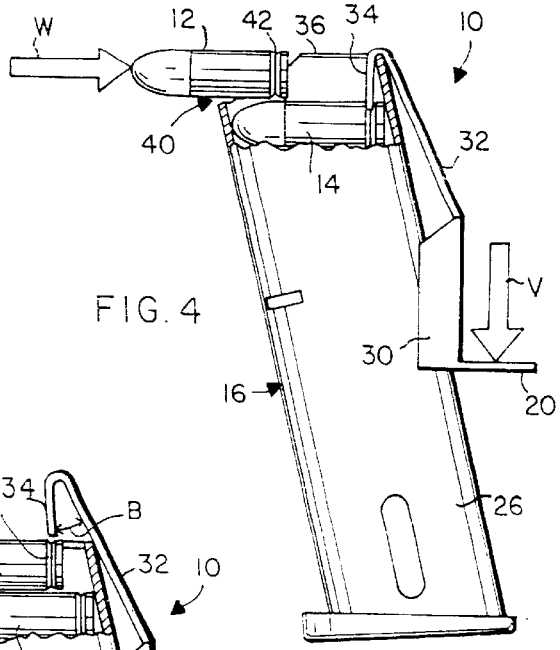
FIG. 4 is a side view of the cartridge-loading device positioned on a magazine and pressing one cartridge downwardly as another cartridge is slid laterally into the magazine's mouth at the outset of the cartridge loading cycle.
Figure 5:
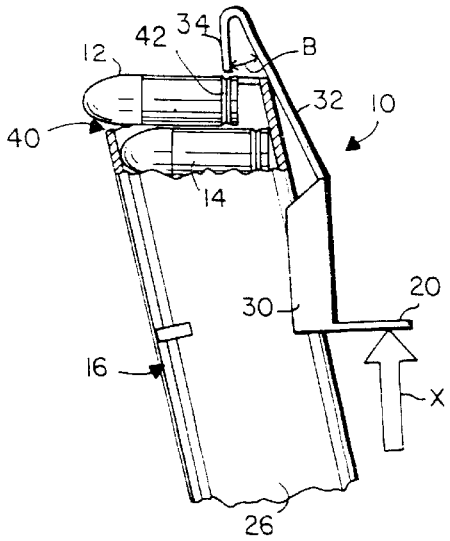
FIG. 5 is a side view of the cartridge loading device positioned on a magazine having portions broken away wherein the device is shifted upwardly from its position in FIG. 4 to grasp the cartridge positioned within the mouth of the magazine.
Figure 6:
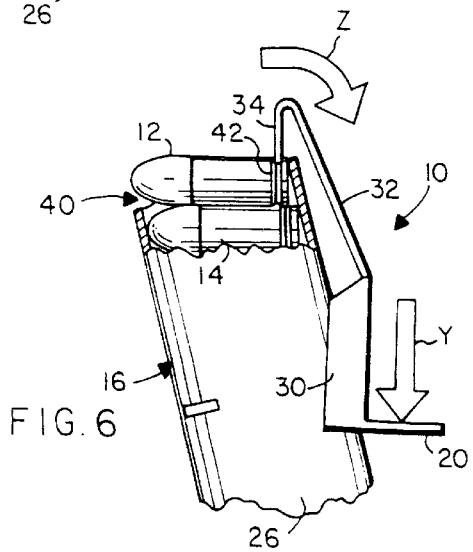
FIG. 6 is a side view of the cartridge loading device positioned on a magazine having portions broken away wherein the device has been shifted laterally and downwardly from its position in FIG. 5 so as to slide the cartridge formerly in the mouth of the magazine fully into the magazine.

Use of device 10 is straightforward. First, as shown in FIG. 4, device 10 is positioned against the rear of magazine 16 and a downward force V is applied to lever 20. Force V drives catch 34 downwardly between lips 36 and presses cartridge 14 downwardly against the force of the magazine's spring (not shown) so that cartridge 12 can be positioned by a light lateral force W within the mouth 40 of magazine 16. Next, as shown in FIG. 5, device 10 is elevated by an upward force X applied to lever 20 so that catch 34 is positioned above the peripheral recess 42 of cartridge 12. Now, as shown in FIG. 6, a downward force Y is applied to lever 20 thereby positioning the concave free end 38 of catch 34 within recess 42 of cartridge 12. Continued downward pressure on lever 20 draws catch 34 rearwardly with a force Z and slides cartridge 12 atop previously loaded cartridge 14 to a position fully within tubular body 26 of magazine 16. Finally, by pressing device 10 downwardly as described with reference to FIG. 4, another cartridge 12 may be inserted within mouth 40 and, the loading process may be repeated until magazine 16 is full.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A device for loading cartridges into a magazine, comprising:

a body having a U-shaped cross section and being adapted to slide up and down upon the exterior of a magazine;

a lever projecting rearwardly from the bottom of said body;

a hook for grasping and manipulating cartridges, said hook having:

a shank attached to the top of said body and extending upwardly therefrom; and, a catch attached to the top of said shank and extending downwardly and forwardly therefrom, said catch terminating at a concave free end adapted to snugly engage a cartridge.

2. The device according to claim 1 wherein said body, said lever and said hook are integrally formed from a single piece of sheet metal.

3. A device for loading cartridges into a magazine, comprising:

a body having a U-shaped cross section and being adapted to slide up and down upon the exterior of a magazine, said body including:

a rectangular plate having opposite sides and being dimensioned for positioning against the rear of a magazine; and, a pair of retaining arms projecting forwardly from said opposite sides of said plate, said retaining arms being adapted for sliding engagement with the sides of a magazine;

a lever projecting rearwardly from the bottom of said body; and, a hook for grasping and manipulating cartridges, said hook having:

a shank attached to the top of said plate and extending upwardly and forwardly therefrom; and, a catch attached to the top of said shank and extending downwardly and forwardly therefrom, said catch terminating at a concave free end adapted to snugly engage a cartridge.

4. The device according to claim 3 wherein said body, said lever and said hook are integrally formed from a single piece of sheet metal.

5. A device for loading cartridges into a magazine, comprising:

a body having a U-shaped cross section and being adapted to slide up and down upon the exterior of a magazine, said body including:

a rectangular plate having opposite sides and being dimensioned for positioning against the rear of a magazine; and, a pair of retaining arms projecting forwardly from said opposite sides of said plate, said retaining arms being adapted for sliding engagement with the sides of a magazine;

a lever projecting rearwardly from the bottom of said rectangular plate;

a hook for grasping and manipulating cartridges, said hook having:

a shank attached to the top of said rectangular plate and extending upwardly and forwardly therefrom, said shank tapering in width from its bottom to its top; and, a catch attached to the top of said shank and extending downwardly and forwardly therefrom, said catch terminating at a concave free end adapted to snugly engage a cartridge; and, said body, said lever, and said hook being integrally formed from a single piece of sheet metal.

* * * * *